United States Patent [19]

Tkach et al.

[11] 4,070,948

[45] Jan. 31, 1978

[54] PNEUMATIC IMPACT DEVICES

[76] Inventors: Khaim Berkovich Tkach, ulitsa Gogolya, 17, kv. 49; Alexandr Dmitrievich Kostylev, ulitsa Derzhavina, 19, kv. 44; Konstantin Konstantinovich Tupitsyn, ulitsa Krylova, 3, kv. 37; Konstantin Stepanovich Gurkov, ulitsa Derzhavina, 19, kv. 13; Vladimir Vasilievich Klimashko, ulitsa Novogodnaya, 44, kv. 24; Leonid Georgievich Rozhkov, ulitsa Krylova, 41, kv. 40, all of Novosibirsk; Mikhail Jurievich Bondar, ulitsa Zhukovskogo, 22a, kv. 4, Odessa; Boris Nikolaevich Smolyanitsky, ulitsa O.Dundicha, 27, kv. 18, Novosibirsk, all of U.S.S.R.

[21] Appl. No.: 631,622

[22] Filed: Nov. 13, 1975

Related U.S. Application Data

[63] Continuation of Ser. No. 484,224, June 28, 1974, abandoned.

[51] Int. Cl.[2] ..... E21B 1/06; E21C 19/00

[52] U.S. Cl. ..... 91/234; 91/235; 173/136; 175/19

[58] Field of Search ..... 91/234, 325, 49, 50, 91/235; 173/135–137

[56] References Cited

U.S. PATENT DOCUMENTS

| | | | |
|---|---|---|---|
| 692,388 | 2/1962 | Vaughn | 91/234 X |
| 1,726,352 | 8/1929 | Hulshizer | 91/234 X |
| 3,241,239 | 3/1966 | Ellis | 91/234 |
| 3,692,122 | 9/1972 | Curington | 173/136 |

*Primary Examiner*—Stephen J. Novosad
*Assistant Examiner*—William F. Pate, III
*Attorney, Agent, or Firm*—Holman & Stern

[57] ABSTRACT

The present invention relates to pneumatic impact devices and can be used to the best advantage for making holes in compacted soils.

The device is provided with a hollow casing which accommodates a stepped ram with the maximum-diameter step in its front part. This step has longitudinal channels which open at one end into a working chamber defined by the maximum-diameter step and the side walls of the casing and serving for receiving compressed air from the compressed air line, with the air moving the striker to impart a blow after which it is discharged through holes in the casing.

6 Claims, 5 Drawing Figures

PNEUMATIC IMPACT DEVICES

This is a continuation of application Ser. No. 484,224 filed June 28, 1974 now abandoned.

BACKGROUND OF THE INVENTION

The present invention relates to impact devices and more specifically to pneumatic impact devices.

The invention can be used to the best advantage for making holes in compacted soils, and for driving pipes, earthing electrodes and wooden or metal sheet piles into the ground.

Known in the Prior Art art are pneumatic impact devices used, for example, for making holes in the ground, consisting of a casing, a ram and an air-distributing mechanism. However, these devices are not in widespread use due to their inherent disadvantages.

It happens frequently that the device which has stopped in the hole cannot be restarted and must be removed which is not always possible. These disadvantages are attributable mostly to an imperfect design of the air-distributing mechanisms which are highly sensitive to impact load, deformations of the casing and jamming of the ram in the casing.

The above disadvantages can be eliminated to a considerable extent with the aid of devices in which the air-distributing mechanisms are installed on a damper.

OBJECTS AND SUMMARY OF THE INVENTION

Such devices include pneumatic impact devices comprising a hollow cylindrical casing accommodating a ram, a stepped slide valve, a flange, a tubular damper and a nut (see, for example, U.S. Pat. No. 3,410,354, Federal Republic of Germany Pat. No. 1,634,579. In these devices, the ram provided with an axial channel and radial channels in the tail part rests on the inner walls of the casing by two projections (with a provision of reciprocating motion) and its front end defines, together with the casing walls, a chamber which is filled with compressed air from a compressed air line through said channels and such air reciprocates the ram. The slide valve is a two-step bushing located in the tail part of the casing and its maximum-diameter step is located in the axial channel of the ram. The bushing communicates the source of compressed air with the radial channels which are periodically closed by said slide valve during the movement of the ram.

The minimum-diameter step of the bushing is connected by a tubular damper with a flange which is fastened rigidly to the tail part of the casing by a nut and has holes for the discharge of the used air.

Such a design of the air-distributing mechanism is highly involved. Besides, the ram often becomes jammed in the slide valve while the tubular damper is unreliable and short-lived which frequently leads to failures of the slide valve.

OBJECTS AND SUMMARY OF THE INVENTION

An object of the present invention resides in eliminating the aforesaid disadvantages.

An object of the invention consists in providing a pneumatic impact device which is compact and simple in design.

Another object of the invention consists in providing a device which is reliable in operation.

An important object of the invention consists in providing a device with a reliable system of air distribution without a slide-valve air-distributing mechanism.

Still another object of the invention consists in raising the impact power and output of the device and in reducing the consumption of compressed air.

These and other objects are achieved by providing a pneumatic impact device which comprises a hollow cylindrical casing, a nut which closes the open end of the casing, and a stepped ram provided with an axial channel and radial channels, said ram being located in the casing with a provision for reciprocating therein and defining by its front part, together with the casing walls, a chamber which is filled with compressed air from a compressed air line through said channels, said compressed air moving the ram for delivering an impact and then escaping outside through discharge holes in which, according to the invention, each succeeding step of the ram in the direction from the nut to the front end of the ram has a larger diameter than the preceding step, with the minimum-diameter step being located in the nut while the maximum-diameter step has longitudinal channels which open at one end into the chamber for placing it periodically in communication with the compressed air line.

Such a design ensures compactness, simplicity and reliability because this device has no slide-valve air-distributing mechanism. The provision of a three-step ram with longitudinal channels therein ensures efficiency of the device, reliable starting and simplicity of maintenance in operation.

To simplify the design of the device and reduce its size, it is practicable that the casing be provided with a circular recess which defines, together with the cylindrical surface of the maximum-diameter ram step, a space which communicates with the other ends of all the longitudinal channels.

The simplicity of design is achieved by making the ram with two steps which is possible due to the provision of a circular recess in the casing, communicating with the chamber through longitudinal channels.

It is also practicable that the other end of each longitudinal channel of the maximum-diameter step of the ram opens on the face surface of said step and that the cross-sectional area of these channels be smaller than that of the radial channels of the ram.

This ensures the discharge of the used air through the nut thereby dispensing with the side holes in the casing and improving the strength of the casing. For addition, in this case there is no need in the housing which is installed on the casing in order to protect the inside spaces of the device against dirt or foreign matter.

The cross-sectional area of the longitudinal channels must be two to five times smaller than that of the radial channels for ensuring the reversal of the ram.

To reduce the consumption of compressed air, it is practicable that the casing be provided with a circular recess which defines, together with the cylindrical surface of the minimum-diameter ram step, a space which is in constant communication with the atmosphere through the longitudinal holes in the nut, with said holes also serving as discharge holes while each longitudinal channel communicates with the space at the end of the back stroke of the ram.

The reduction of air consumption is achieved because the longitudinal channels place the chamber in communication with the atmosphere via the space not constantly but only at the end of the back stroke of the ram.

In the designs described above, the pressure of the compressed air acts not on the maximum cross-sectional area of the ram but on its minimum-diameter step which impairs the efficiency of the device.

To counter this disadvantage, it is necessary that the minimum-diameter step of the ram be provided with a projection and a bushing for joint movement with the ram, with said bushing having side holes and an external circular recess through which said space communicates periodically with the atmosphere through the longitudinal holes in the nut, that said holes open at one end on the internal cylindrical surface of the nut, with the latter being provided with inlet channels for the delivery of compressed air through the side holes of the bushing into said space when the ram moves towards the nut, and that the inlet channels of the nut open on its inner cylindrical surface.

Such a design increases the efficiency of the device since, in the course of the working stroke of the ram, the space is communicated with the source of compressed air which allows the maximum cross-sectional area of the ram to be used for its acceleration.

To make the invention more apparent, it will now be described in detail by way of example with reference to the accompanying drawings, in which:

DETAILED DESCRIPTION OF THE INVENTION

Figure 1:
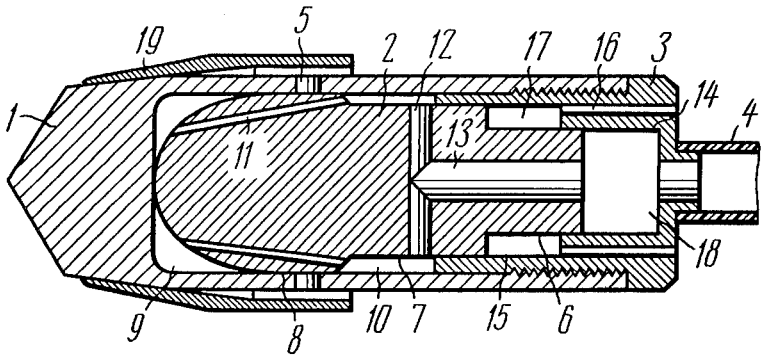
FIG. 1 is a side view of the pneumatic impact device according to the invention, the view being in longitudinal section.

The pneumatic impact device for making holes in the ground according to the invention comprises a hollow cylindrical casing 1 (FIG. 1) which accommodates a stepped ram 2 and a nut 3 which closes the open end of the casing 1 and to which a compressed air line 4 is connected. The compressed air line is connected to a source of compressed air of any known type, e.g. a compressor.

The side walls of the casing 1 are provided with holes 5. The ram 2 has three cylindrical steps 6,7,8 whose diameters increase towards its front end. The front part of the maximum-diameter step 8 of the ram 2 defines, together with the walls of the casing 1, a working chamber 9. The cylindrical part of the ram step 7 and the side walls of the casing 1 define a space 10. The step 8 of the ram 2 has longitudinal channels 11 which communicate the working chamber 9 with the space 10. The ram 2 has radial channels 12 which open on the cylindrical surface of the step 7 and communicate with an axial channel 13 which is in communication with the compressed air line. The inner cylindrical surface of the nut is made in the form of two steps 14 and 15 and has channels 16 which are open to the atmosphere at one end and communicate at the other end with a space 17 which is defined by the outer cylindrical surface of the step 6 of the ram 2 and by the inner cylindrical surface of the step 15 of the nut 3. The cylindrical surfaces of the ram steps 6 and 7 interact with the cylindrical surfaces, respectively, of the steps 14 and 15 of the nut 3. The compressed air line 4 is in constant communication with a space 18 which is defined by the face surface of the ram step 6 and by the cylindrical and face surface of the nut step 14. The front part of the casing 1 is provided with a protective housing 19 which keeps foreign matter from entering into the device.

Figure 2:
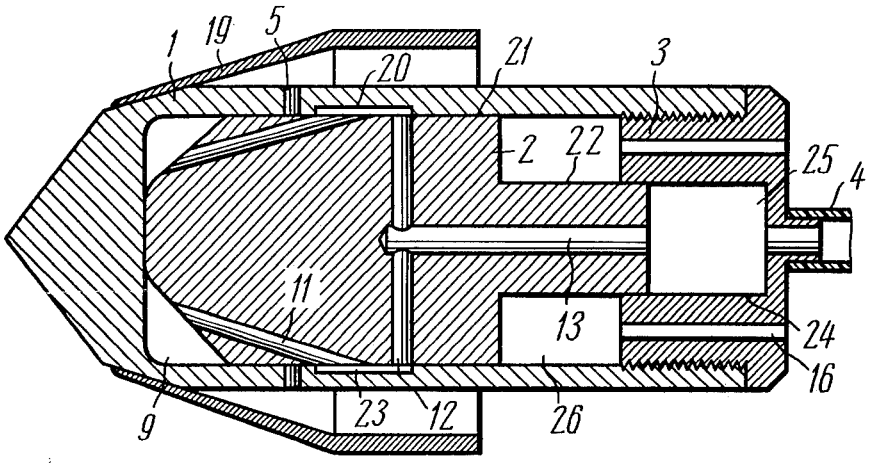
FIGS. 2 through 5 are side views of the versions of the device according to the invention, the views being longitudinal section.

To reduce the size of the device and to simplify its design, the casing 1 has a circular recess 20 (FIG. 2). The ram 2 is made in the form of two cylindrical steps 21 and 22. The cylindrical surface of the maximum-diameter step 21 of the ram 2 and the circular recess 20 of the casing 1 define a space 23 which communicates with the working chamber 9 through the longitudinal channels 11 of the ram 2.

The radial channels 12 of the ram 2 opening on the cylindrical surface of its step 21 communicate with the space 23 when the ram is in the front (working) position.

The nut 3 has an inner cylindrical surface 24 which interacts with the outer cylindrical surface of the minimum-diameter step 22 of the ram 2 and provides together with its face surface, a chamber 25. A space 26 is defined by the outer cylindrical surface of the ram step 22 and the inner walls of the casing 1 and is open to the atmosphere through the channels 16 of the nut 3.

To simplify the design of the device and increase the strength of the casing, the longitudinal channels 11 (FIG. 3) of the maximum-diameter step 21 of the ram 2 open on the face surface of such step and communicate the working chamber 9 with the atmosphere through the space 26 and the channels 16 of the nut 3. The cross-sectional area of the channels 11 of the ram 2 is considerably smaller (by two to five times) than that of the radial channels 12 of the ram 2. The inner recess 20 of the casing 1 has a shoulder 27. When the ram 2 in the forward position, its radial channels 12 communicate directly with the chamber 9.

To reduce the consumption of air, the casing 1 has an additional circular recess 28 (FIG. 4) with a shoulder 29. The recess 28 provides, together with the outer cylindrical surface of the minimum-diameter step 22 of the ram 2, a space 30 which is in constant communication with the atmosphere through the channels 16 of the nut 3. The longitudinal channels 11 of the ram 2 open at one end into the working chamber 9 while their other ends open on the outer cylindrical surface of the maximum-diameter step 21 of the ram 2. As the ram 2 moves towards the nut 3 and passes the shoulder 29 at the end of its the back stroke, the channels 11 place the chamber 9 in communication with the atmosphere through the space 30 and the channels 16 of the nut 3.

To increase the impact power and output of the device, the minimum-diameter step 22 of the ram 2 is provided with an outwardly extending projection or flange 31 (FIG. 5) and a bushing 32 which has side holes 33 and an outer circular recess 34 through which the space 30 is placed periodically in communication with the atmosphere through the channels 16 of the nut 3. One end of each channel 16 opens on the inner cylindrical surface 24 of the nut 3. The nut 3 has inlet channels 35 for the supply of compressed air from the air line 4 through side holes 33 into the space 30 when the ram 2 moves towards the nut 3.

Each channel 35 opens on the inner surface 24 of the nut 3. The inner surface of the bushing 32 has a recess 36 with an internal projection 37 which interacts with the projection 31 on the back stroke of the ram.

The device operates as follows:

In FIG. 1, as compressed air is delivered from the compressed air line 4 into the space 18, the air starts to flow through the channels 13 and 12 of the ram 2 into the space 10 and further, through the longitudinal channels 11, into the working chamber 9. Due to the difference between the areas of the face surfaces of the steps 8 and 6 of the ram 2, the ram starts moving towards the nut 3. During this movement, the radial channels 12 are covered by the inner cylindrical surface of the step 15 of the nut 3 so that the further movement of the ram 2 will be executed due to the expansion of the compressed air in the working chamber 9. At the end of the back stroke of the ram 2, the holes 5 of the casing 1 are placed in communication with the working chamber 9 and the compressed air is discharged from the working chamber 9 into the atmosphere. The ram is stopped during the back stroke and moved forward by the pressure of compressed air in the space 18. In the extreme forward position (at the end of the working stroke), the ram 2 imparts a blow to the casing 1, driving it into the ground. The radial channels 12 of the ram 2 communicate with the space 10, the compressed air is admitted into the working chamber 9 and the working cycle is repeated over again.

To prevent formation of an air bumper in the space 17 during the back stroke of the ram 2, the channels 16 of the nut 3 keep this space in constant communication with the atmosphere.

If the device is made as shown in FIG. 2, it functions similarly for except the fact that the compressed air enters the working chamber 9 through the space 23 and the channels 11. On the back stroke of the ram 2, its radial channels 12 are covered by the inner cylindrical surface of the casing 1.

Figure 3:
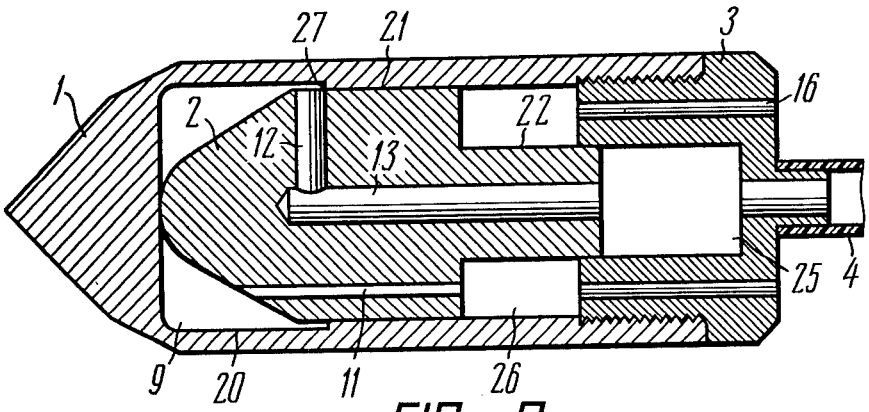

When the device is constructed as shown in FIG. 3, it functions as follows.

As the compressed air is delivered from the air line 4 into the chamber 25, the air starts flowing through the channels 13 and 12 into the working chamber 9.

Due to the difference between the areas of the face surfaces of the steps 21 and 22 of the ram 2, the ram starts moving towards the nut 3. During this movement, the radial channels 12 are covered by the inner cylindrical surface of the casing 1.

The area through the longitudinal channels 11 is deliberately made smaller than that through the radial channels 12, and hence the working chamber 9 is filled with air when the ram 2 is in the front position and the radial channels 12 are open, so that the entire volume of the chamber 9 becomes suddenly filled whereas the discharge of air into the atmosphere is by a gradual flow through the channels 11 of the ram 2, through the space 26 and the channels 16 of the nut 3 within the entire back stroke of the ram 2. The gradual discharge (throttling) of the air during the back stroke of the ram 2 reduces the dynamic loads of the air discharge. The ram 2 is stopped at the end of the back stroke and is moved forward by the pressure of compressed air in the chamber 25. When the ram 2 is in the extreme forward position (at the end of the working stroke), it imparts blows to the casing 1, thus driving it into the ground. The radial channels 12 of the ram 2 communicate with the working chamber 9 which starts to be filled with compressed air and the working cycle is repeated again.

Figure 4:
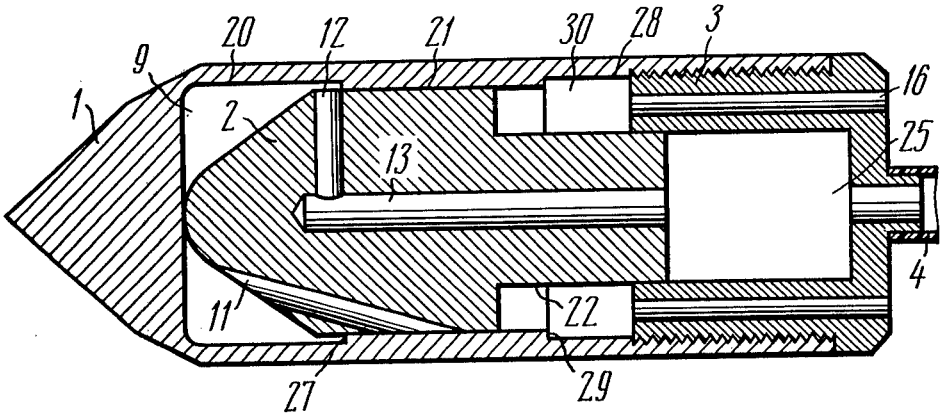

If the device is of the type shown in FIG. 4, it functions similarly to the device illustrated in FIG. 3 except for the fact that the air is discharged from the working chamber 9 not in the course of the entire back stroke of the ram but at the moment when the channels 11 have passed the shoulder 29 and are connected with the space 30.

Figure 5:
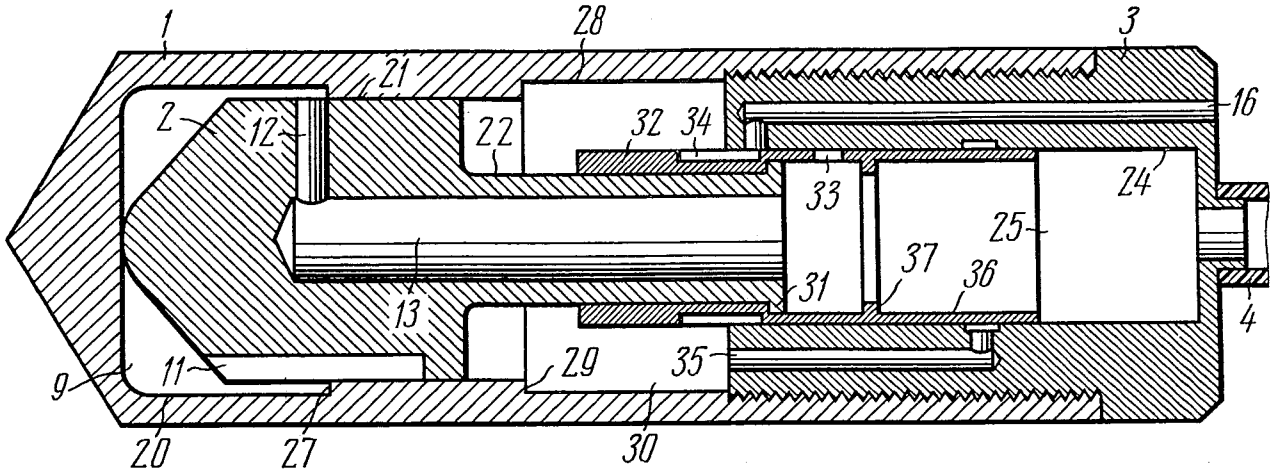

If the device is in compliance with the construction illustrated FIG. 5, it functions as follows: when compressed air is supplied from the air line 4 into the chamber 25, it flows through the channels 13 and 12 of the ram 2 into the working chamber 9. Due to the difference between the areas of the face surfaces of the ram steps 21 and 22, the ram 2 starts moving towards the nut 3. During this movement, the radial channels 12 are covered by the inner cylindrical surface of the casing 1 so that the working chamber 9 is separated from the air line 4 and the back stroke continues to be executed due to the expansion of air in the chamber 9. At a preset distance from the beginning of the back stroke of the ram, the channels 11 pass beyond the shoulder 29 of the recess 28 of the casing 1 and the air is discharged from the chamber 9 into the atmosphere through the space 30, recess 34 of the bushing 32 and through the channels 16 of the nut 3. During the back stroke of the ram 2, its projection 31 comes to bear against the projection 37 of the bushing 32, and shifts it towards the nut 3 until the holes 33 of the bushing 32 are aligned with the channels 35 of the nut 3 which admits compressed air from the chamber 25 into the space 30. Under the pressure of the compressed air from the side of the chamber 25 and space 30, the ram begins moving on its working stroke. Upon covering a preset distance, the ram 2 comes to bear with its projection 31 against the front (in the drawing) edge of the recess 36 of the bushing 32 and continues moving together therewith. During the movement of the bushing 32, its holes 33 are covered by the inner cylindrical surface 24 of the nut 3 while the inlet channels 35 of the nut 3 are covered by the outer cylindrical surface of the bushing 32 thereby cutting off the space 30 from the chamber 25 and, as a consequence, from the compressed air line 4. During the remaining part of the working stroke, the ram 2 moves due to the expansion of air in the space 30 and to the pressure of air entering the channel 13 from the chamber 25. At the end of the ram working stroke, the circular recess 34 of the bushing 32 places the space 30 in communication with the atmosphere through the channels 16 of the nut 3 so that air is discharged from the space 30. Upon coming to the extreme front position, the ram 2 imparts blows to the casing 1 thus driving it into the ground. At this moment, the radial channels 12 of the ram 2 pass the projection 27 of the circular recess 20 of the casing 1 and connect the working chamber 9 with the compressed air line 4 via the channel 13 and the chamber 25. Compressed air is admitted into the chamber 9 and the working cycle is repeated again.

We claim:

1. A pneumatic impact device, comprising a hollow, cylindrical casing having side walls and an open end, said side walls having holes; a nut which closes the open end of said casing; a stepped ram located in said casing with a provision for reciprocating motion; an axial channel and radial channels in said ram; a compressed air line, said axial and radial channels being connected to the compressed air line; a step of said ram with a minimum diameter, said step of minimum diameter being located in said nut; another step of said ram with a maximum diameter and serving as the front part of said ram, said maximum-diameter step defining, together with the side walls of said casing, a working chamber receiving compressed air from said compressed air line through said channels of the ram, the pressure of this air being used to move the ram for striking a blow after which the air is discharged through said holes of the casing, and longitudinal channels in said maximum diameter step opening at one end into said working chamber for its periodical connection with said compressed air line, said casing having a circular recess which defines, together with the cylindrical surface of the minimum diameter step of the ram, a space which communicates with the other ends of all the longitudinal channels during the movement of the ram towards the nut, with said space being in constant communication with the atmosphere through longitudinal holes in the nut.

2. The device according to claim 1 in which the minimum-diameter step of the ram has a projection and a bushing for joint movement with the ram, said bushing being provided with side holes and an outer cylindrical recess through which said space communicates periodically with the atmosphere through the longitudinal holes of the nut, one end of each of said holes opening on the inner cylindrical surface of said nut which is provided with inlet channels for the delivery of compressed air through the side holes of the bushing into said space when the ram moves towards the nut; and in this position, the inlet channels of the nut open on its inner cylindrical surface.

3. A pneumatic impact device comprising a hollow cylindrical casing with side walls, an open end and a closed end;

a nut closing the open end of said casing, said nut being provided with outlet channels and having an inner space;

a multi-stepped ram located within said casing and adapted to reciprocate therein, an axial channel provided in said stepped ram and opening with one of the ends thereof on an end-surface of a maximum diameter step on said multi-stepped ram, a radial channel in said ram and communicating an outer surface of the maximum diameter step of said ram with said axial channel;

a compressed air line for constantly communicating pressure to the inner space of said nut, a smaller diameter step on said multi-stepped ram, being disposed and extending within the inner space of said nut and subject to air pressure therein, said maximum diameter step of said ram comprising a front part of said ram and interacting with the inner surface of said casing, said maximum diameter step having at least one longitudinal channel and defining with the side walls and the closed end of the casing a working chamber for receiving compressed air from the compressed air line and the inner space of said nut through said channels of the ram, the pressure of said compressed air reacting on said smaller diametered step in said inner space of said nut to move the ram for delivering a blow and functioning to discharge the air thereafter, said longitudinal channel communicating constantly with the working chamber and periodically with the inner space of the nut and the compressed air line.

4. A pneumatic impact device according to claim 3, wherein said longitudinal channel of the maximum diameter step of the stepped ram communicates with an end face surface of said step facing the nut;

the cross-section area of said longitudinal channel being substantially smaller than that of the radial channels of said stepped ram.

5. A pneumatic device according to claim 3, wherein the casing is provided with a circular recess on an end facing the nut and forming together with a cylindrical surface of the smaller diameter step of the stepped ram a space which communicates with all longitudinal channels during the movement of said stepped ram towards said nut;

said space being constantly in communication with the atmosphere through the longitudinal channels of the nut.

6. A pneumatic device according to claim 3, wherein the smaller diameter step of the stepped ram is provided with a projection, a bushing on the projection and adapted for combined movement with the stepped ram;

said bushing having at least one side hole and a circumferential cylindrical recess through which a space behind said maximum diameter step periodically communicates with the atmosphere through longitudinal channels in the nut, one end of each channel communicating with an inner cylindrical surface of said nut, which is provided with the compressed air line to admit the compressed air into said space of said nut through said side holes of said bushing when the ram moves towards the nut; and in this position, an inlet channel in the nut communicates with the inner cylindrical surface of the nut.

* * * * *